United States Patent [19]

Harbison

[11] 4,371,325

[45] Feb. 1, 1983

[54] APPARATUS FOR FORMING STRUCTURES IN THE FORM OF SEGMENTS OF A SPHERE

[76] Inventor: Charles H. Harbison, 3217 Georgetown Pl., Birmingham, Ala. 35216

[21] Appl. No.: 138,298

[22] Filed: Apr. 8, 1980

[51] Int. Cl.[3] ..... E04B 2/84

[52] U.S. Cl. ..... 425/63; 249/20; 249/154; 249/155; 264/32; 264/33

[58] Field of Search ..... 425/63; 264/32, 33; 249/20, 154, 155

[56] References Cited

U.S. PATENT DOCUMENTS

| | | | |
|---|---|---|---|
| 2,837,910 | 6/1958 | Steed | 72/129 |
| 3,298,155 | 1/1967 | Byfield et al. | 52/749 |
| 3,365,855 | 1/1968 | Vermette | 52/741 |
| 3,590,448 | 7/1971 | Bryant | 425/63 |
| 3,735,546 | 5/1973 | Newman | 52/749 |
| 4,320,075 | 3/1982 | Nielson | 264/32 |

*Primary Examiner*—James H. Derrington
*Attorney, Agent, or Firm*—Woodford R. Thompson, Jr.

[57] ABSTRACT

A method and apparatus for forming a structure having an inner surface in the form of at least one segment of a sphere. An inner support is mounted at a fixed point from which a radius can be struck to define the inner surface of the structure. An elongated radial member is pivotally connected at one end to the inner support with its other end being movable vertically and horizontally. A forming member at the other end of the elongated member has an outer surface in the shape of the inner surface of the segment to be formed. An actuator moves the elongated member horizontally and vertically to selected positions to place the outer surface of the forming member opposite and adjacent the inner surface of each segment being formed. A forming material is applied to the outer surface of the forming member while it is opposite and adjacent the inner surface of the segment being formed to form each segment directly on the forming member.

7 Claims, 10 Drawing Figures

FIG. 3
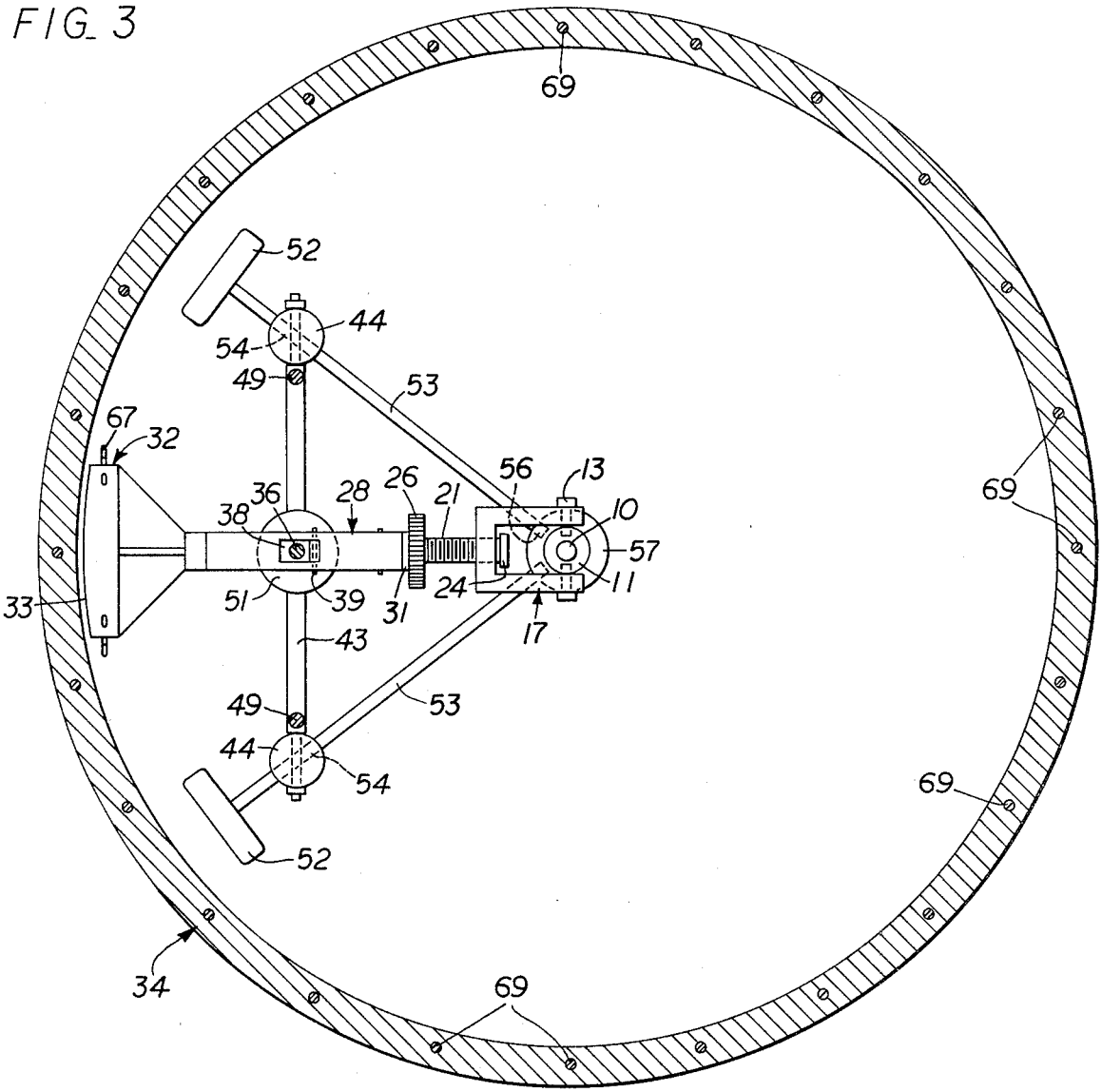
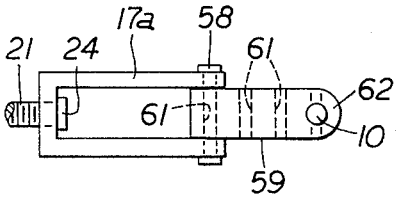
FIG. 4
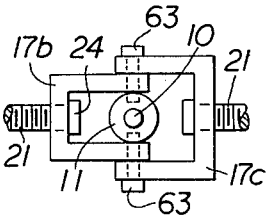
FIG. 5
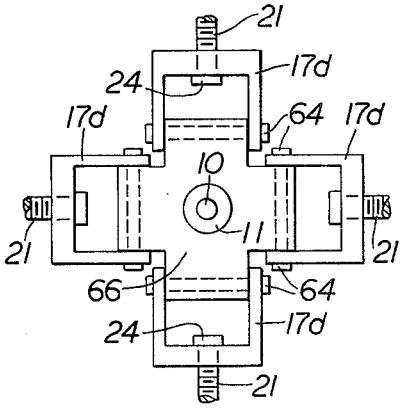
FIG. 6

FIG. 7
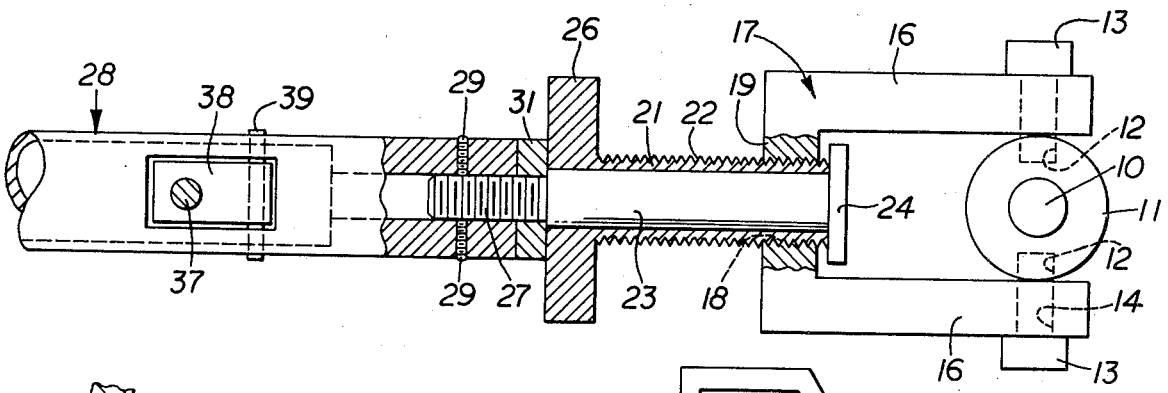
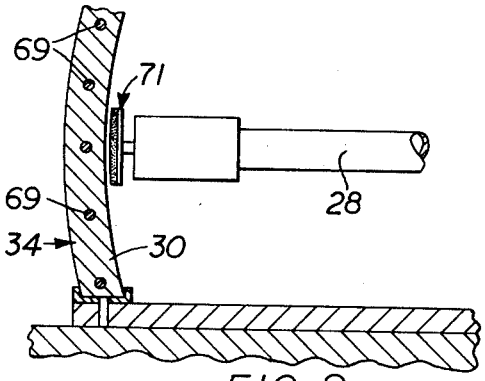
FIG. 9
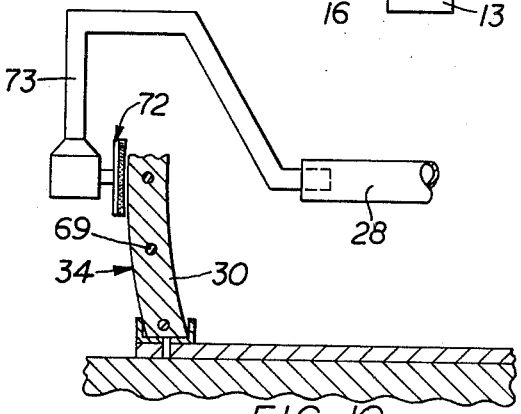
FIG. 10
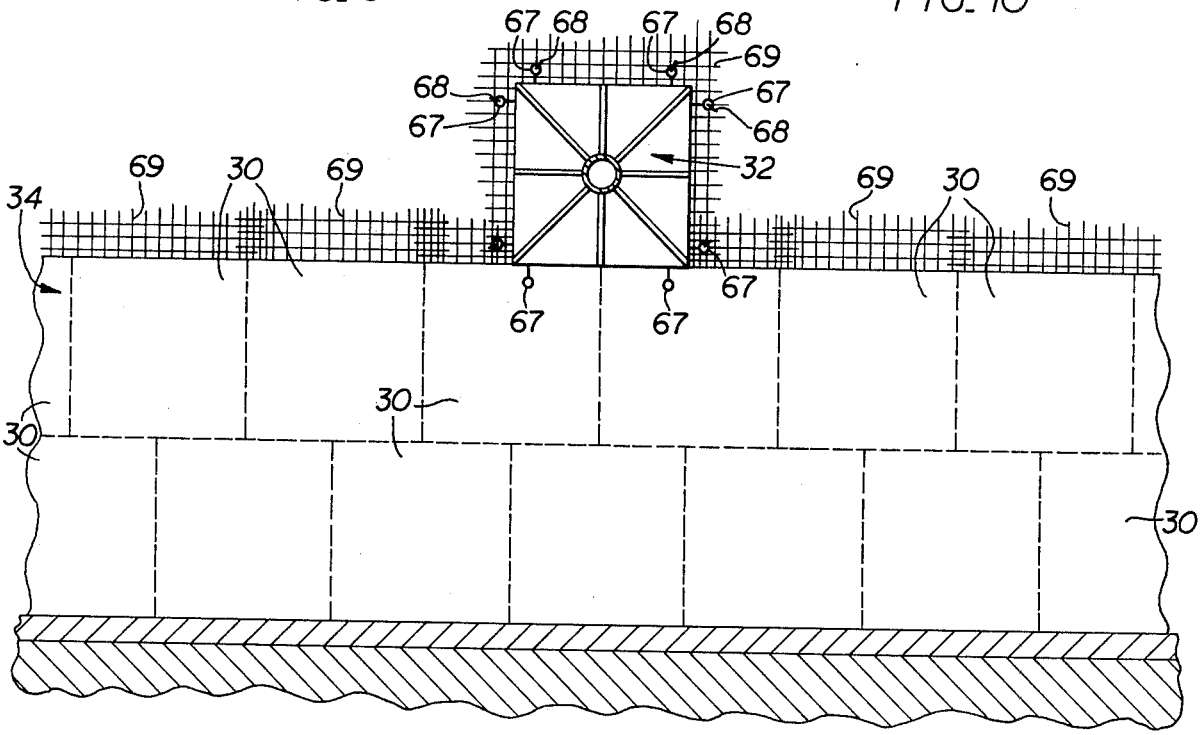
FIG. 8

APPARATUS FOR FORMING STRUCTURES IN THE FORM OF SEGMENTS OF A SPHERE

BACKGROUND OF THE INVENTION

This invention relates to a method and apparatus for forming structures in the form of segments of a sphere and more particularly to such a structure in which the inner surface thereof is defined by at least one segment of a sphere. My improved method and apparatus is particularly adapted for forming dome-shaped structures formed of suitable materials, such as concrete, fiberglas, foams and the like. Also, my method and apparatus would be adapted for forming many other large size articles, such as parabolic reflectors for solar energy collectors or reflectors for microwave reception.

Heretofore in the art to which my invention relates, many devices have been proposed for forming dome-shaped buildings and circular structures wherein components of the apparatus were carried by arms supported from a centrally disposed member, such as that shown in the Steed U.S. Pat. No. 2,837,910 and the Vermette U.S. Pat. No. 3,365,855. However, difficulties have been encountered with such apparatus due to the fact that the structure still had to be formed by laying blocks and applying mortar thereto or by pouring a material, such as concrete, between form members. Also, various type devices have been proposed for lining kilns, such as that disclosed in the Byfield et al U.S. Pat. No. 3,298,155 and the Newman U.S. Pat. No. 3,735,546. With such apparatus annular rows of bricks, blocks or the like are positioned against a cylindrical wall.

SUMMARY OF THE INVENTION

In accordance with my invention, I provide an improved method and apparatus for forming a structure having an inner surface in the form of at least one segment of a sphere wherein an elongated, radially extending member is pivotally supported at its inner end at a fixed point from which a radius can be struck to define the inner surface of the structure to be formed. The outer end of the elongated member is movable both vertically and horizontally and carries a forming member having an outer surface in the shape of the inner surface of the segment to be formed. An actuator moves the elongated member horizontally and vertically to selected positions to place the outer surface of the forming member opposite and adjacent the inner surface of the segment being formed. A suitable forming material is applied directly to the outer surface of the forming member while it is opposite and adjacent the inner surface of the segment being formed to thus form the segment on the forming member. Accordingly, a plurality of adjacent segments of a sphere may be formed without leaving seams or other connecting surfaces therebetween. Also, the formation of a substantially continuous surface provides a much stronger structure which makes it possible to reduce the thickness of the structure. Furthermore, such a continuous joint between adjacent segments of the structure provides a water-tight and air-tight seal therebetween without the addition of additional sealing means between adjacent segments of the structure.

DESCRIPTION OF THE DRAWINGS

Apparatus embodying features of my invention and which may be employed to carry out my improved method is illustrated in the accompanying drawings, forming a part of this application, in which:

FIG. 3 is a horizontal sectional view taken generally along the line 3—3 of FIG. 1;

FIGS. 4, 5 and 6 are fragmental views showing modifications of the means for pivotally mounting the elongated, radially extending member;

FIG. 7 is an enlarged, fragmental, sectional view, partly broken away, showing the means for varying the effective length of the elongated, radially extending member;

FIG. 8 is a fragmental, vertical sectional view showing two of the lower tiers of segments completed and showing the forming member in position to start formation of the third tier;

FIG. 9 is a fragmental, sectional view showing a finishing tool carried by the outer end of the elongated, radially extending member in position to apply a finished or polished surface to the inner surface of a segment of the sphere being formed; and, FIG. 10 is a fragmental, sectional view showing another modified form of my invention wherein a finishing tool is carried by the elongated, radially extending member in position to finish the exterior surface of the segment of the sphere being formed.

DETAILED DESCRIPTION

Figure 1:
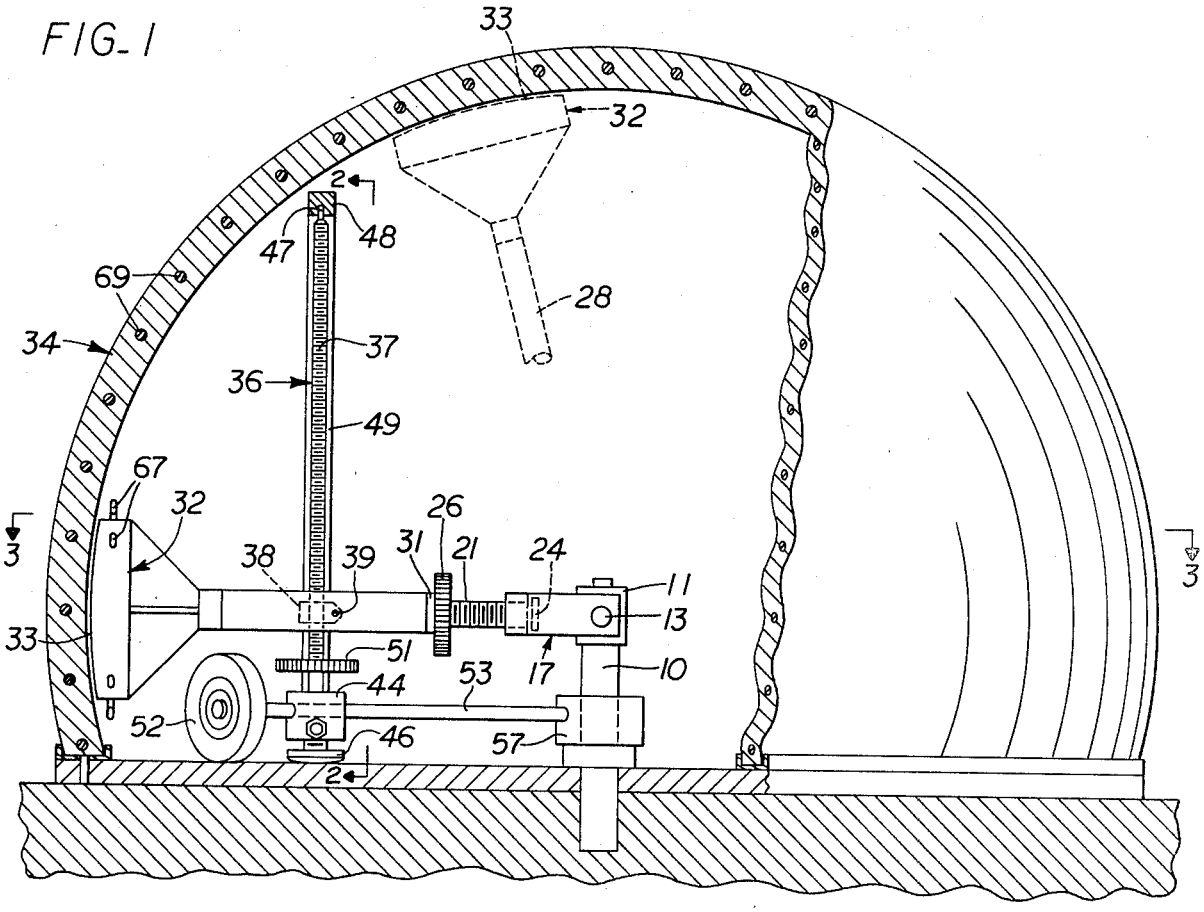
FIG. 1 is a side elevational view, partly broken away and in section, showing the apparatus mounted within a completed dome-shaped structure.

Referring now to the drawings for a better understanding of my invention, I show an inner support member 10 which is adapted to be mounted at a fixed point relative to the structure to be formed with such point being so positioned that a radius can be struck therefrom to define the inner surface of the segment of a sphere to be formed. As shown in FIG. 1, the inner support member 10 may be in the form of a vertical shaft anchored at its lower end into a suitable foundation, as shown. Mounted for rotation about the upper portion of the inner support member 10 is a collar 11 which is mounted in a suitable bearing unit that prevents axial movement of the collar 11 relative to the inner support member 10. That is, the collar 11 is adapted for rotation about the inner support member 10 but is held against axial movement relative thereto. The collar 11 is provided with outwardly opening recesses 12 at opposite sides thereof, as shown in FIG. 7, for receiving the inner ends of pivot members 13 which pass through suitable openings 14 provided in parallel legs 16 of a clevis member 17. A threaded opening 18 is provided in the base 19 of the clevis member 17 for receiving an elongated tubular member 21 having external threads 22 which are in threaded engagement with the threads 18. An elongated shaft-like member 23 extends through the tubular member 21 and is provided with a stop member 24 at its inner end in position to engage the adjacent end of the tubular member 21 to thus limit axial movement of the shaft-like member 23 relative to the tubular member 21 and at the same time permit the tubular member 21 to rotate about the shaft-like member 23. The outer end of the tubular member 21 carries an operating disc 26 which permits the tubular member 21 to be rotated relative to the clevis 17, as shown.

The outer end of the shaft-like member 23 is shown as being reduced in diameter as at 27 and fixedly secured to the inner end of an elongated, radial member 28 by suitable screws 29. A spacer washer 31 is interposed between the inner end of the radial member 28 and the operating disc 26, as shown in FIG. 7. It will thus be seen that upon rotation of the operating disc 26 the effective length of the elongated radial member 28 may be varied.

The outer end of the elongated radial member 28 carries a forming member 32 having an outer surface 33 which is of a shape corresponding to the inner surface of a segment of a sphere to be formed, with the structure of the sphere being indicated generally at 34.

Figure 2:
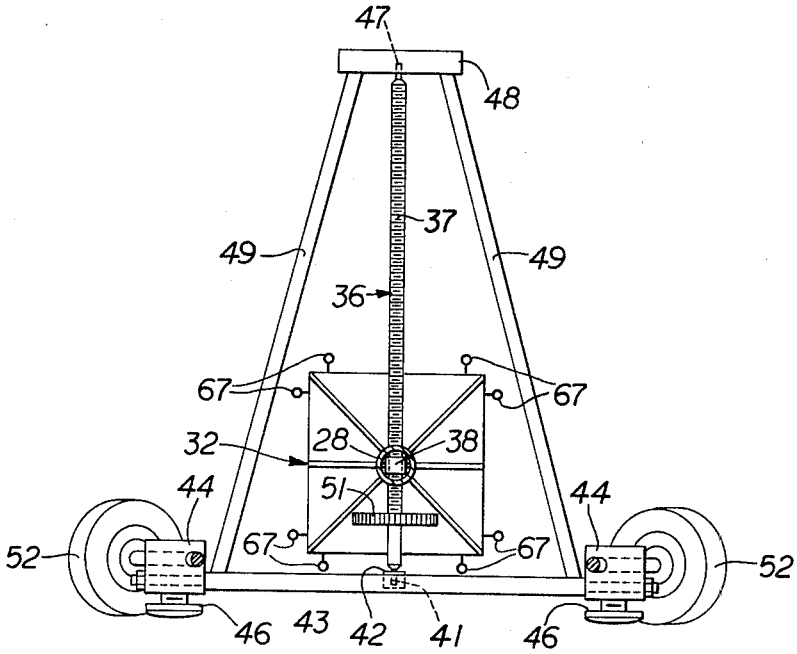
FIG. 2 is a sectional view taken generally along the line 2—2 of FIG. 1.

As shown in FIGS. 1, 2 and 3, an actuator unit 36 is operatively connected to the elongated radial member 28 and is adapted to move the radial member 28 and the forming member 32 carried thereby vertically to selected angular locations to position the outer surface 33 of the forming member 32 opposite and adjacent the location of the inner surface of a segment 30 of the sphere 34 to be formed. Accordingly, each segment of a sphere to be formed is formable directly onto the outer surface 33 of the forming member 32. The actuator unit 36 comprises an upstanding threaded member 37 which is in threaded engagement with a threaded bracket 38 carried by a central portion of the elongated radial member 28, as shown in FIGS. 1, 2 and 3. The bracket 38 is pivotally connected to the elongated radial member 28 by a transverse pin 39. The lower end of the upstanding threaded member 36 is reduced in diameter as at 41 and is mounted for rotation in a suitable bearing unit 42. As shown in FIG. 2, the bearing unit 42 is carried by an elongated frame member 43 which is pivotally connected at opposite ends to bearing blocks 44 which carry adjustable jack units 46 for supporting the member 43 at selected level elevations.

The upper end of the upstanding threaded member 36 carries a reduced diameter portion 47 which telescopes into an opening in a top bracket 48 which is supported by a pair of upstanding support members 49, as shown. The lower ends of the support members 49 are secured to the transverse member 43 whereby the support members 49 rotate with the top bracket 48 and the elongated member 43 to thus provide a translatable frame. The upstanding threaded member 36 carries an operating wheel or disc 51 which permits the threaded member 36 to be rotated to thus move the elongated radial member 28 vertically to selected positions. That is, upon rotation of the operating disc 51, the elongated radial member 28 is raised or lowered whereby it pivots about the pivot pins 13 to move vertically to selected positions, as indicated by the solid line and dotted line positions in FIG. 1.

The translatable frame defined by the elongated member 43, upstanding members 49 and the top bracket 48 may be supported by supporting wheels 52 carried by elongated shaft-like members 53 which extend through suitable openings 54 provided in the bearing blocks 44. The inner ends of the shaft members 53 extend into and are secured to recesses 56 provided in a support member 57 which is adapted for rotation about the inner support member 10. Accordingly, the supporting wheels 52 are adapted for rotation along a circular path within the structure 34, as shown in FIG. 3. Accordingly, the translatable frame supported by the wheels 52 is adapted for horizontal movement within the structure 34.

Referring now to FIGS. 4, 5 and 6 of the drawings, I show modifications of the means for pivotally connecting the clevis to the inner support member 10. In FIG. 4, I show the base of a clevis member **17*a* as being connected to the tubular member 21, as described above, with the legs of the clevis member 17*a* being connected by a pivot pin 58 to selected, spaced apart openings 61 provided in an elongated extension member 59. The inner end of the elongated extension 59 is formed integrally with a collar-like member 62 which is carried by the inner support member 10. Accordingly, the effective length of the radial member 28 may be varied by moving the pin 58 to selected ones of the openings 61**.

In FIG. 5, I show a pair of oppositely disposed clevis-like members **17*b* and 17*c* which are connected to the collar 11 by suitable pivot pins 63 which pass through the legs of the clevis members 17*b* and 17*c* as shown. The collar 11 is mounted for rotation about the inner support member 10 while the base of each clevis member 17*b* and 17*c* is threadedly connected to a tubular member 21**.

In FIG. 6 of the drawings, I show two pairs of oppositely disposed clevis-like members **17*d* which are connected by suitable pivot pins 64 to an intermediate plate-like member 66 which in turn is secured rigidly to the collar-like member 11 that is mounted for rotation about the inner support member 10. The base of each clevis member 17*d* is threadedly connected to a tubular member 21, as described above. It will thus be seen that by employing the apparatus shown in FIG. 5, two oppositely disposed radial members 28 may be supported from the inner support member 10 while in FIG. 6, four radial members 28 may be supported from a single inner support member 10 with adjacent radial members 28 being spaced angularly from each other approximately 90°. It will be apparent that other arrangements may be provided whereby the radial members 28** are supported at selected angular positions relative to each other.

As shown in FIGS. 1, 3 and 8, each forming member 32 carries attaching elements 67 around the periphery thereof for detachably connecting support members, such as wires 68, to reinforcing members 69 to be embedded in the structure 34, as shown. That is, the reinforcing members 69 are provided in segments slightly larger than the adjacent surface of its forming member 32 whereby the reinforcing members 69 project outwardly thereof, as shown in FIG. 8. The segment of a reinforcing member 69 is attached to any adjacent reinforcing members 69 which have been previously formed within segments 30, as shown in FIG. 8. The attaching elements 67 are then attached to the sides and upper portion of the segment of the reinforcing member 69 by means of the attaching elements 68 to thus hold the segment of the reinforcing member 69 in proper, spaced relation to the face 33 of the forming member 32 whereby the reinforcing members 69 are embedded within the structure 34, as shown. The outer surface 33 of the forming member 32 is also polished so as to provide a smooth surface which may be readily separated from the segment 30 of the structure 34 formed directly on the outer surface 33.

As shown in FIG. 9, the inner surface of the segment of the structure 34 may be finished by mounting a finishing tool 71 at the outer end of the elongated radial member 28. Accordingly, the finishing tool 71 is adapted for horizontal and vertical movement about the inner support member 10 to thus provide a finished or polished inner surface which corresponds to the shape of the segment of a sphere thus formed. To obtain the polished or finished surface, relative movement is imparted between the finishing tool 71 and the segment of a sphere to be finished until the desired finish is produced.

In FIG. 10, I show another modified form of my invention in which a finishing tool 72 is supported from the outer end of the elongated radial arm 28 whereby it is positioned opposite and adjacent the location of the outer surface of the segment of a spherical structure 34. This may be accomplished by employing a support member 73 of a generally inverted U-shape with one leg of the member 73 being attached to the radial arm 28 and the other depending leg carrying the finishing tool 72. Accordingly, each segment 30 of the structure 34 being formed is polished or finished before the superjacent segment 30 is formed thereon. The finishing tool 72 would be moved relative to the adjacent outer surface of the segment 30 being finished until the desired finish is produced. It will be apparent that the apparatus shown in FIGS. 9 and 10 would be particularly adapted for finishing the surfaces of parabolic reflectors for solar energy collectors or reflectors for microwave reception.

From the foregoing description, the operation of my improved apparatus will be readily understood. As shown in FIG. 8, each segment 30 of the structure to be formed is generally rectangular with each section being of a shape corresponding to the outer surface 33 of the forming member 32. The reinforcing members 69 are supported from the forming member 32 by the attaching element 68 and may also be attached to previously erected reinforcing members 69 whereby the reinforcing members 69 are in proper, spaced relation to the outer surface 33 of the forming member 32 adjacent thereto. To move the forming member 32 to selected positions relative to the inner support member 10, the operating disc 26 is rotated in the proper direction. To position the forming member 32 at selected vertical positions, the operating disc 51 is rotated whereby the forming member 32 is adapted to move to selected angular positions, such as that shown in solid lines and dotted lines in FIG. 1. To move the forming member 32 angularly in a horizontal plane, the entire translatable frame supported by the wheels 52 is moved to selected angular positions. Accordingly, the forming member 32 is adapted to be moved selectively to any horizontal or vertical position within the structure 34, which may be in the form of a sphere or a segment of a sphere.

After positioning the forming member 32 in proper relation to a segment of the forming member 69, as shown in FIG. 8, cement or other plastic material may be sprayed onto the outer surface 33 of forming member 32 to thus form a segment 30 of the structure 34. To form the next segment 30 at the same elevation as the last formed segment, the translatable frame carrying the forming member 32 is moved angularly about the inner support member 10 as it is supported by the wheels 52 to thus position the forming member 32 at the proper location to form the next segment 30. The next segment of the reinforcing members 69 is then secured in place, as described above, whereupon the cement or other plastic material is sprayed onto the outer surface 33 to form the next segment 30.

To form a segment 30 at an elevation above the first row of segments formed, the operating disc 51 is rotated to cause the radial member 28 to move upwardly toward the dotted line position shown in FIG. 1 whereupon it is then stopped at the proper location to form an adjacent upper segment 30. This procedure is repeated until the entire structure 34 is formed. Since the outer surface 33 of the forming member 32 is in the shape of a segment of a sphere, the entire inner surface of the structure 34 is of the same contour.

It will be understood that my improved process and apparatus could be employed to form various shaped structures, such as structures with the upper portion thereof being eliminated entirely to thus provide an upstanding wall-like structure which is provided with an inner surface in the shape of a segment of a sphere. Also, adjacent segments of a sphere could be connected to each other to form a composite structure which comprises a plurality of segments of spheres.

From the foregoing, it will be seen that I have devised an improved method and apparatus for forming a structure having an inner surface in the form of at least one segment of a sphere. By providing a forming member having an outer surface in the shape of the inner surface of the segment of a sphere to be formed and supporting the forming member for horizontal and vertical movement about a fixed point from which a radius can be struck to define the inner surface of the segment of a sphere to be formed, the segment is accurately formed in a quick and easy manner and at the same time adjacent segments may be formed adjacent to previously formed segments to provide a substantially continuous structure, thus eliminating seams and providing a strong structure which may be formed of a minimum width.

While I have shown my invention in several forms, it will be obvious to those skilled in the art that it is not so limited, but is susceptible of various other changes and modifications without departing from the spirit thereof.

What I claim is:

1. Apparatus for forming a structure having an inner surface which defines at least one segment of a sphere comprising:

(a) an inner support member embodying an upstanding shaft-like member adapted to be anchored to a fixed point from which a radius can be struck to define the inner surface of the segment to be formed, (b) a collar-like member mounted for rotation on said shaft-like member, (c) a U-shaped clevis-like member having its legs pivotally connected to said collar-like member, (d) an elongated tubular member having external threads in threaded engagement with a threaded opening through the base of said U-shaped clevis-like member, (e) an elongated shaft-like element extending through said tubular member, (f) an elongated radial member secured at one end to one end of said shaft-like element with the other end of said radial member extending outwardly from said shaft-like element and with said radial member adapted for horizontal pivotal movement and vertical pivotal movement relative to said inner support member, (g) a stop member carried by the other end of said shaft-like element in position to engage the adjacent end of said tubular member and limit axial movement of said shaft-like element relative to said tubular member, (h) means for rotating said tubular member relative to said clevis-like member to vary the effective length of said radial member, (i) a forming member carried by said other end of said radial member with the other surface of said forming member being in the shape of the inner surface of said segment of a sphere to be formed, and (j) actuator means operatively connected to said radial member and adapted to pivot said radial member horizontally and vertically to selected angular locations to position the outer surface of said forming member carried by said radial member opposite and adjacent the location of the inner surface of said segment of a sphere to be formed so that said segment is formable directly on the outer surface of said forming member.

2. Apparatus for forming a structure as defined in claim 1 in which a pair of oppositely disposed clevis-like members are connected to said collar-like member.

3. Apparatus for forming a structure as defined in claim 1 in which two pairs of oppositely disposed clevis-like members are connected to said collar-like member with adjacent clevis-like members being spaced approximately 90° from each other.

4. Apparatus for forming a structure as defined in claim 1 in which said actuator means comprises:

(a) an elongated upstanding threaded member in threaded engagement with said elongated radial member between said inner support member and said forming member, (b) means supporting the lower end of said upstanding threaded member for pivotal movement, and (c) means for rotating said upstanding threaded member to move said elongated radial member to said selected angular locations.

5. Apparatus for forming a structure as defined in claim 4 in which said means supporting the lower end of said upstanding threaded member comprises a translatable frame having an inner portion pivotally connected to said inner support member and an outer portion carrying a pivotal connection for receiving the lower end of said upstanding threaded member.

6. Apparatus for forming a structure as defined in claim 5 in which said outer portion of the translatable frame carries supporting wheels which are mounted for rotation along a circular path within said structure.

7. Apparatus for forming a structure as defined in claim 6 in which said outer portion of the translatable frame carries jack units for supporting said translatable frame at selected level elevations.

* * * * *